US006456313B1

(12) United States Patent
Hiyoshi

(10) Patent No.: US 6,456,313 B1
(45) Date of Patent: Sep. 24, 2002

(54) METHOD AND APPARATUS FOR OPTICAL WRITING CAPABLE OF EFFECTIVELY PERFORMING AN ACCURATE SCANNING

(75) Inventor: Takayuki Hiyoshi, Tokyo (JP)

(73) Assignee: Ricoh Company Ltd., Tokyo (JP)

( * ) Notice: Subject to any disclaimer, the term of this patent is extended or adjusted under 35 U.S.C. 154(b) by 23 days.

(21) Appl. No.: 09/661,386

(22) Filed: Sep. 13, 2000

(30) Foreign Application Priority Data

Sep. 13, 1999 (JP) ..... 11-259126

(51) Int. Cl.[7] ..... B41J 2/45; B41J 2/385
(52) U.S. Cl. ..... 347/238; 347/130
(58) Field of Search ..... 347/136, 137, 347/238, 241, 256, 130; 257/93, 94; 438/6, 31

(56) References Cited

U.S. PATENT DOCUMENTS 5,260,718 A * 11/1993 Rommelmann et al. .... 347/136
5,510,633 A * 4/1996 Orlowski et al. ..... 257/93

FOREIGN PATENT DOCUMENTS

JP 64-16342 1/1989

FOREIGN PATENT DOCUMENTS

JP 64-16342 1/1989

* cited by examiner

*Primary Examiner*—Hai Pham
(74) *Attorney, Agent, or Firm*—Oblon, Spivak, McClelland, Maier & Neustadt, P.C.

(57) ABSTRACT

An optical writing device includes light-emitting element array substrates, connecting members, self-focusing rod-shaped lens arrays, and a package case. Each of the light-emitting element array substrates includes light-emitting elements arranged in a line for emitting light in a straight line. The light-emitting element array substrates are placed in parallel and partly in an overlapping formation to be able to write on an area of a predetermined width in a direction in which the plurality of light-emitting elements of each of the light-emitting element array substrates are arranged in the line. Each connecting members connects two adjacent light-emitting element array substrates to each other around a position, at which an operation for writing dots with the light-emitting elements, is switched from one of the light-emitting element array substrates to a subsequent one of the light-emitting element array substrates. The self-focusing rod-shaped lens arrays are arranged in positions corresponding to positions of the light-emitting elements of the light-emitting element array substrates. The package case packages the light-emitting element array substrates and the self-focusing rod-shaped lens arrays into one device.

12 Claims, 6 Drawing Sheets

METHOD AND APPARATUS FOR OPTICAL WRITING CAPABLE OF EFFECTIVELY PERFORMING AN ACCURATE SCANNING

CROSS-REFERENCE TO RELATED APPLICATIONS

This application claims priority to Japanese patent application No. JPAP11-259126 filed on Sep. 13, 1999 in the Japanese Patent Office, the entire contents of which are hereby incorporated by reference.

BACKGROUND OF THE INVENTION

1. Field of the Invention

The present invention relates to a method and apparatus for optical writing, and more particularly to a method and apparatus for optical writing that is capable of effectively performing an accurate scanning.

2. Description of Background

An optical writing device has been developed that includes a light-emitting element array unit employing a plurality of light-emitting elements (i.e., light-emitting diodes (LED)) arranged in a line on substrates. This optical writing device is configured to cause the light-emitting elements to emit light to expose a charged surface of a photoconductive member, which is a writing object, so as to form an electrostatic latent image on the photoconductive member. With such an optical writing device, it is possible to write an image of various sizes. However, to write an A0-scaled image, for example, the optical writing device needs to have a light-emitting element array unit having a width of approximately 1 meter. Manufacturing of such a long light-emitting element array unit which may have a resolution of 400 dpi (a dot-pitch of 63.5 $\mu$m), for example, requires expensive tools, such as a wide LED-chip mounter, a wide wire bonding machine, and so on.

In addition, a unit cost of self-focusing rod-shaped lens arrays (i.e., a SELFOC lens array (SLA)), correspondingly provided relative to the light-emitting element rows, generally increases as the width increases.

Japanese Laid-Open Utility Publication No. 64-16342 (1989) describes an optical writing device which attempts to avoid the above-mentioned drawbacks. This optical writing device arranges several light-emitting element array units in a formation in order to make one longer light-emitting element array unit.

In this case, however, positions of the light-emitting element array units require accurate adjustments to write a straight line with dots. This can become problematic. That is, if a dot-pitch error is greater than approximately 5 $\mu$m, an image will generally be reproduced with dirty marks of black lines or white lines. Yet, the dot pitch of the 400-dpi resolution is 63.5 $\mu$m. Under this circumstance, connecting portions of the light-emitting element array units are sensitive to variations of environmental temperature, which is prone to increase due to actions of light emission by a large number of the light-emitting elements and so on. In other words, the merely-connected portions in the conventional device will be extended due to an increase of environmental temperature, causing a change of the dot pitch at each of the connecting portions.

More specifically, if parameters are set in such a way that a distance between connecting points of a connecting member for connecting a plurality of the light-emitting element array units is 20 mm, the connecting member is made of iron having a linear expansion coefficient of 0.000012 per degree, and an increase in temperature of 30 degrees, it will cause at least a dot-pitch error of 7.2 $\mu$m, because an initial positioning error will be added so that an extent of the dot pitch error becomes greater. Therefore, a reproduced image will have the above-mentioned dirty marks around the connected portions of the light-emitting element array units.

Further, a casing for supporting the light-emitting element array substrates is usually made of a different material from that of the substrates and therefore, the linear expansion coefficients of the casing and the substrates are generally different. Moreover, the casing and the substrates generally have temperature distributions different from each other.

Therefore, a mere connection of the bodies of the light-emitting element array units will cause a large deviation of the dot pitch between the connected portions of the adjacent light-emitting element array units. In addition, a dot-pitch error in a sub-scanning direction orthogonal to the light-emitting element rows is prone to be caused also due to an increase in temperature.

SUMMARY OF THE INVENTION

The present invention provides a novel optical writing device. In one example, a novel optical writing device includes a plurality of light-emitting element array substrates, a plurality of connecting members, a plurality of self-focusing rod-shaped lens arrays, and a package case. Each of the plurality of light-emitting element array substrates includes a plurality of light-emitting elements arranged in a line for emitting light in a straight line. The plurality of light-emitting element array substrates are located parallel to each other and partly in an overlapping formation so as to be able to write on an area of a predetermined width in a direction in which the plurality of light-emitting elements, of each of the plurality of light-emitting element array substrates, are arranged in a line. Each of the plurality of connecting members connects two adjacent light-emitting element array substrates to each other around a position at which an operation for writing dots with the plurality of light-emitting elements is switched from one of the plurality of light-emitting element array substrates to a subsequent one of the plurality of light-emitting element array substrates. The plurality of self-focusing rod-shaped lens arrays are arranged in positions corresponding to positions of the plurality of light-emitting elements of the plurality of light-emitting element array substrates. The package case packages the plurality of light-emitting element array substrates and the plurality of self-focusing rod-shaped lens arrays into one device.

The above-mentioned plurality of light-emitting elements and the above-mentioned plurality of self-focusing rod-shaped lens arrays may be arranged so that the light emitted from the light-emitting elements of the plurality of light-emitting element array substrates come into focus in a straight line along a main scanning direction on a writing surface of a writing object rotating in a sub-scanning direction.

The above-mentioned plurality of light-emitting elements and the above-mentioned plurality of self-focusing rod-shaped lens arrays may be arranged so that each light axes of the light emitted from the light-emitting elements of the plurality of light-emitting element array substrates passes through the plurality of self-focusing rod-shaped lens arrays and is normal to a writing surface of a writing object.

The present invention further provides a novel method for optical writing. In one example, a novel method for optical writing includes the steps of providing, placing, connecting, arranging, and packaging. The providing step provides a plurality of light-emitting elements to a light-emitting element array substrate for emitting light in a straight line. The placing step places a plurality of the light-emitting element array substrates, each having the plurality of light-emitting elements, at positions so as to be parallel to each other and in a partly overlapping formation to be able to write on an area of a predetermined width in a direction in which the plurality of light-emitting elements of each of the plurality of the light-emitting element array substrates emit the light in a straight line. The connecting step connects two adjacent light-emitting element array substrates of the plurality of the light-emitting element array substrates to each other around a position at which an operation for writing dots with the plurality of light-emitting elements is switched from one of the plurality of the light-emitting element array substrates to a subsequent one of the plurality of light-emitting element array substrates. The arranging step arranges a plurality of self-focusing rod-shaped lens arrays at positions corresponding to positions of the plurality of light-emitting elements mounted on the plurality of the light-emitting element array substrates. The packaging step packages the plurality of the light-emitting element array substrates and the plurality of self-focusing rod-shaped lens arrays into one device.

The above-mentioned steps, for providing the plurality of light-emitting elements and for arranging the plurality of self-focusing rod-shaped lens arrays, may be performed so that the light emitted from the light-emitting elements of the plurality of the light-emitting element array substrates comes into focus in a straight line along a main scanning direction on a writing surface of a writing object rotating in a sub-scanning direction.

The above-mentioned steps for providing the plurality of light-emitting elements and for arranging the plurality of self-focusing rod-shaped lens arrays may be performed so that each light axes of the light emitted from the light-emitting elements of the plurality of the light-emitting element array substrates passed through the plurality of self-focusing rod-shaped lens arrays and is normal to a writing surface of a writing object.

BRIEF DESCRIPTION OF THE DRAWING FIGURES

A more complete appreciation of the present application and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
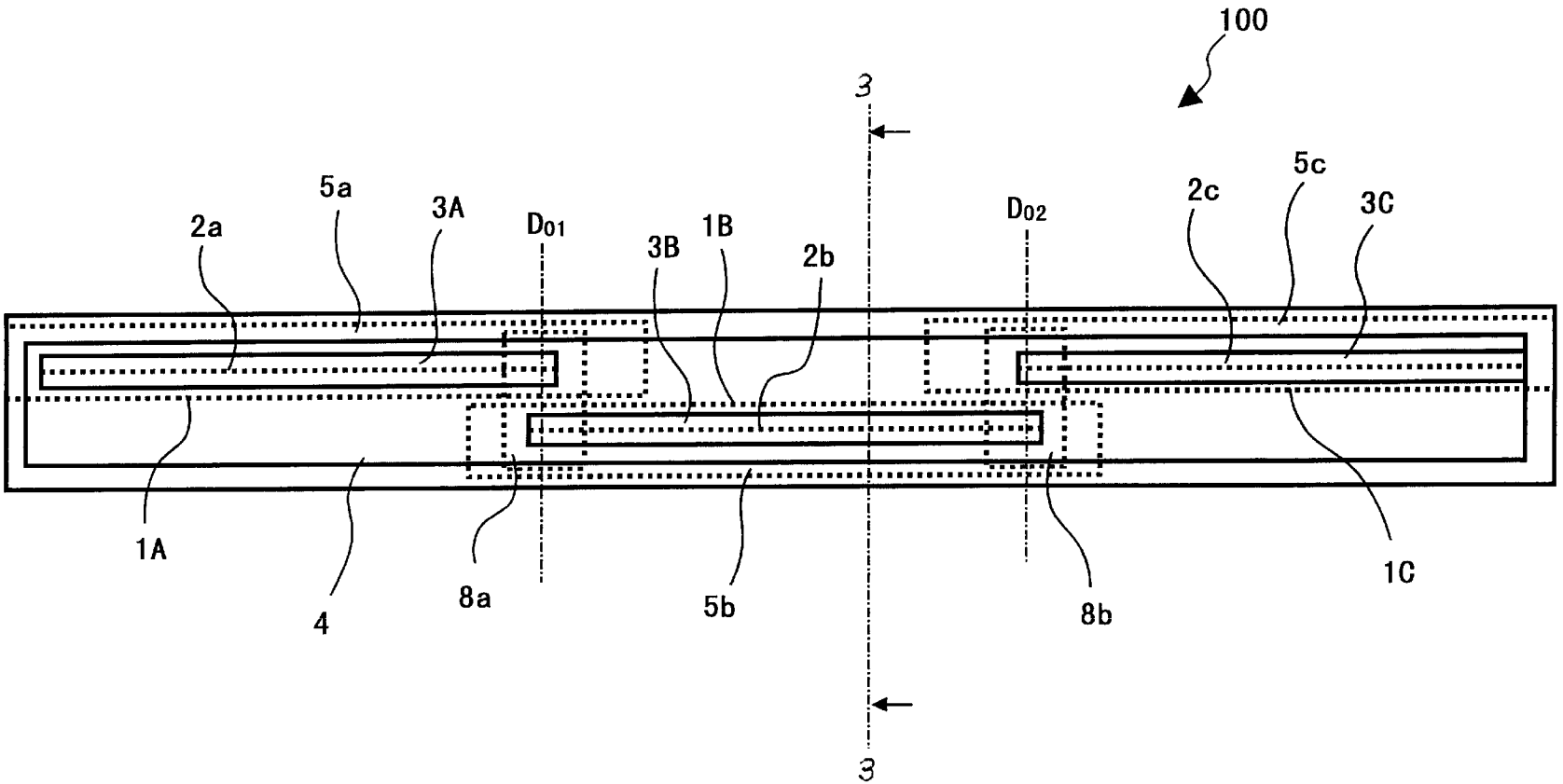
FIG. 1 is a top plan view of an optical writing device according to an embodiment of the present invention.

In describing preferred embodiments illustrated in the drawing figures, specific terminology is employed for the sake of clarity. However, the invention is not intended to be limited to the specific terminology so selected and it is to be understood that each specific element includes all technical equivalents which operate in a similar manner.

Figure 2:
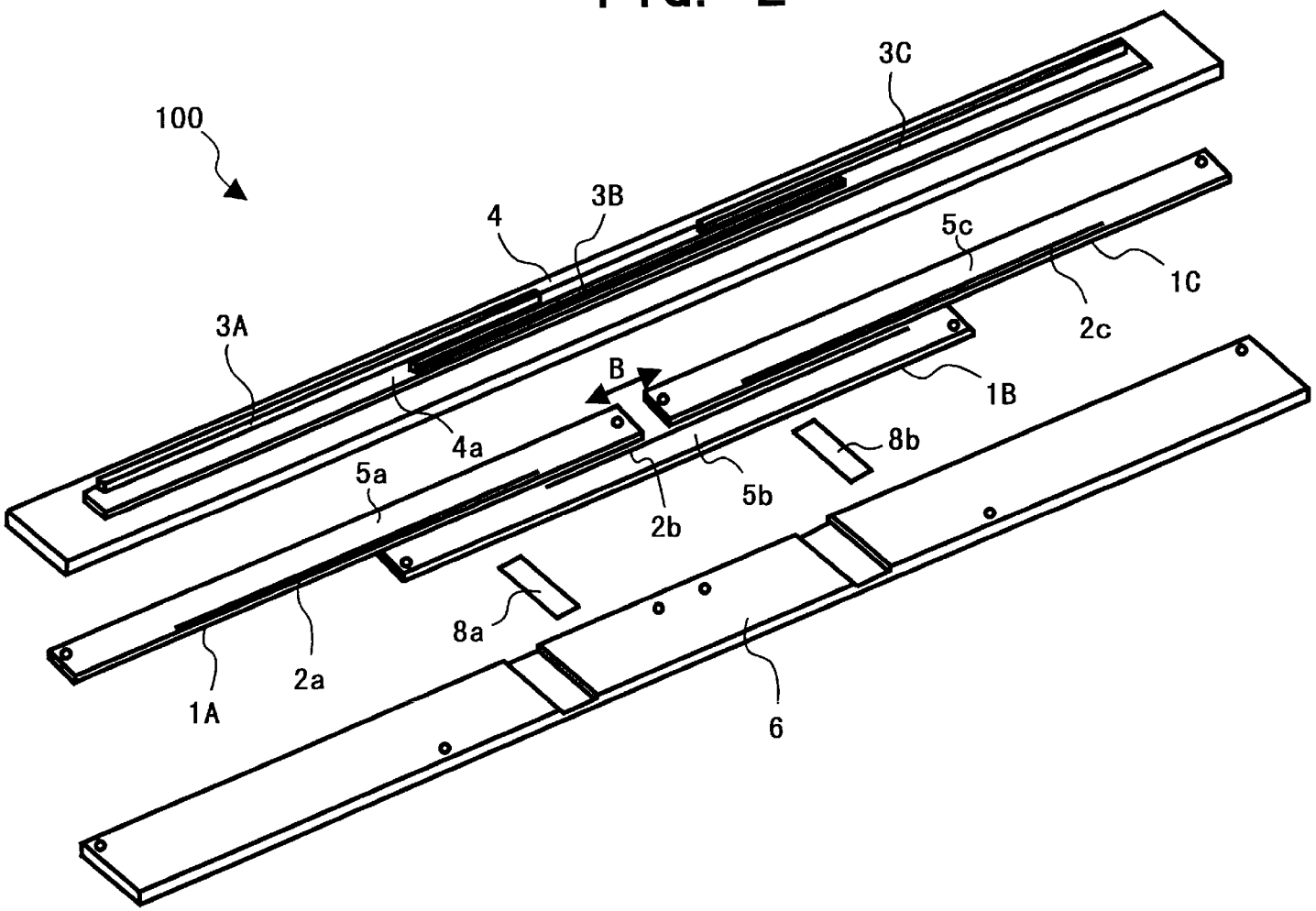
FIG. 2 is a perspective exploded view of the optical writing device of FIG. 1.
Figure 3:
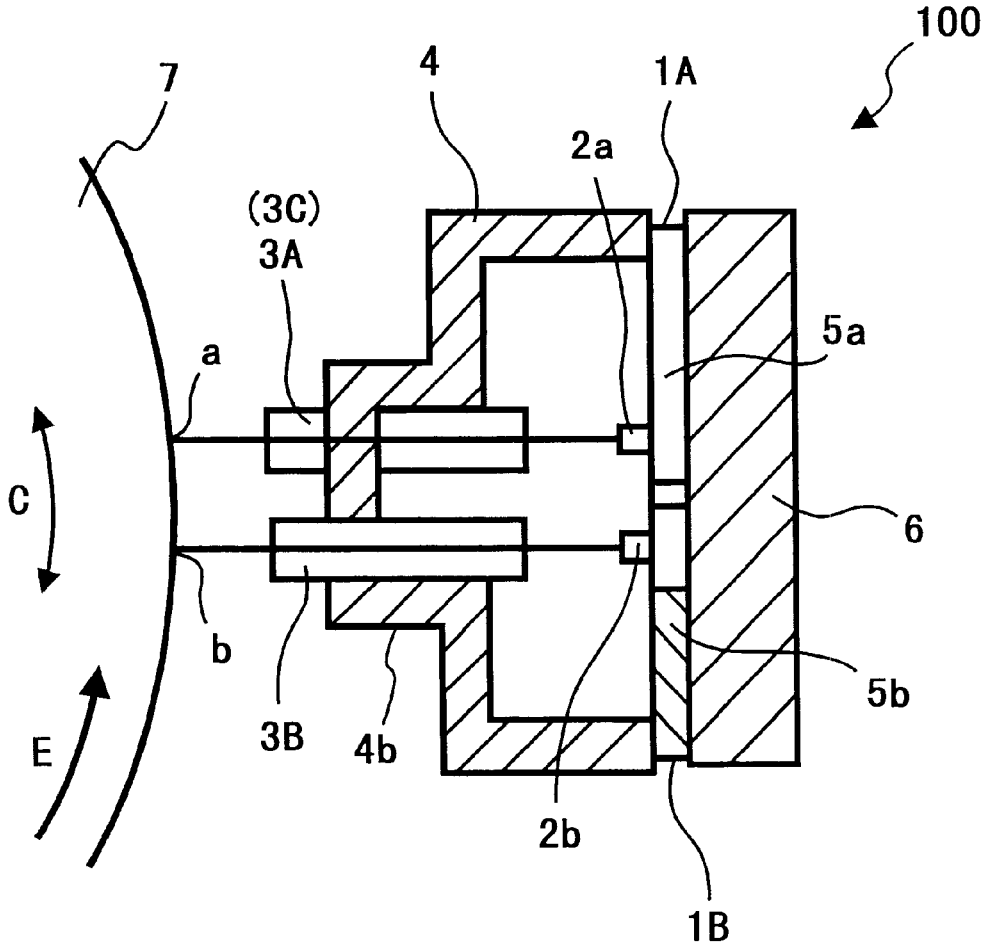
FIG. 3 is a cross-sectional view device taken along line 3—3 of FIG. 1, wherein the optical writing device faces a photoconductive drum of an image forming apparatus in which the optical writing device is installed.

Referring now to the drawing figures, wherein like reference numerals designate identical or corresponding parts throughout the several views, particularly to FIGS. 1–3, an optical writing device 100, according to an embodiment of the present invention, is explained. FIG. 1 is a top plan view of an optical writing device 100 according to an embodiment of the present invention. FIG. 2 is an exploded perspective view of the optical writing device 100 of FIG. 1. FIG. 3 is a cross-sectional view taken along line 3—3 of FIG. 1.

The optical writing device 100 of FIG. 1 includes substrates 5*a,* 5*b,* and 5*c* on which light-emitting element array substrates 1A, 1B, and 1C, respectively, are mounted. As shown in FIG. 2, light-emitting element rows 2*a,* 2*b,* and 2*c,* each having a plurality of light-emitting elements arranged in a line in the main scanning direction indicated by double-sided arrow B, are mounted on the light-emitting element array substrates 1A, 1B, and 1C, respectively. In order to have the light-emitting element rows 2*a,* 2*b,* and 2*c* aligned so as to be able to write on an area of a predetermined width in either direction of double-sided arrow B (FIG. 2), the light-emitting element array substrates 1A, 1B, and 1C are arranged in two rows in a staggered configuration and partly overlapping one another, as shown in FIG. 1.

In FIG. 1, a position, at which an operation for writing dots with the light-emitting elements is switched from the light-emitting element row 2*a* to the light-emitting element row 2*b,* is indicated by a line $D_{01}$. Around this line $D_{01}$, a connecting member 8*a* is mounted with an adhesive agent on surfaces of the adjacent substrates 5*a* and 5*b* opposite to the surfaces on which the light-emitting element rows 2*a* and 2*b* are mounted so as to connect the substrates 5*a* and 5*b* to each other. Also, a position, at which an operation for writing dots with the light-emitting elements is switched from the light-emitting element row 2*b* to the light-emitting element row 2*c,* is indicated by a line $D_{02}$ in FIG. 1. Around this line $D_{02}$, a connecting member 8*b* is mounted with an adhesive agent on surfaces of the adjacent substrates 5*b* and 5*c* opposite to the surfaces on which the light-emitting element rows 2*b* and 2*c* are mounted so as to connect the substrates 5*b* and 5*c* to each other.

Thus, the light-emitting element array substrates 1A and 1B are connected each other and the light-emitting element array substrates 1B and 1C are connected to each other. The light-emitting elements may be provided using more than three light-emitting element array substrates. Each of the light-emitting element rows 2*a*–2*c* is configured to have a plurality of LED (light emitting diode) array chips. In each LED, a plurality of the light-emitting elements (i.e., a plurality of dots) are integrated.

The optical writing device 100 further includes self-focusing rod-shaped lens arrays 3A–3C, a package case 4, and a base 6. The self-focusing rod-shaped lens arrays 3A–3C are mounted on a bed 4*a* of the package case 4 such that they sit in the respective positions corresponding to the light-emitting element rows 2*a*–2*c* on the light-emitting element array substrates 1A–1C. The package case 4 and the base 6 are arranged to sit opposite to each other relative to the substrates 5*a*–5*c*connected and fixed by the connecting members 8*a* and 8*b,* and are fixed with screws so that the packages, of the light-emitting element array substrates 1A–1C and the self-focusing rod-shaped lens arrays 3A–3C, are packaged into one device, as shown in FIG. 3.

The above-mentioned bed 4*a* of the package case 4 is formed in a rectangle having a predetermined length in a longitudinal direction of the package case 4, and has three slits at positions corresponding to the light-emitting element rows 2*a*–2*c.* To these three slits, the self-focusing rod-shaped lens arrays 3A–3C, respectively, are mounted such that the tops of the self-focusing rod-shaped lens arrays 3A–3C protrude slightly from the top surface of the bed 4*a* of the package case 4, as shown in FIG. 3.

In this way, the optical writing device 100 is configured to have an integrated extensive light-emitting element array substrate. This optical writing device 100 is installed in an image forming apparatus such that the tops of the self-focusing rod-shaped lens arrays 3A–3C face a surface of a photoconductive drum 7 and are a predetermined distance away therefrom. The photoconductive drum 7 is included in an image forming mechanism of the image forming apparatus and the optical writing device 100 writes information on the photoconductive drum 7. Under this condition, the light emitted from the light-emitting element rows 2*a* and 2*c,* which passes through the self-focusing rod-shaped lens arrays 3A and 3C, comes into focus on a writing position a, which is predefined in the surface of the photoconductive drum 7 to focus an image thereon. Also, the light emitted from the light-emitting element row 2*b* and passing through the self-focusing rod-shaped lens array 3B comes into focus on a writing position b, which is predefined in the surface of the photoconductive drum 7, to focus an image thereon. That is, in the above configuration, the writing positions a and b on the surface of the photoconductive drum 7 are some distance away from each other in the sub-scanning direction C, as shown in FIG. 3.

Accordingly, to write a line of information in the main scanning direction, the optical writing device 100 is controlled in a special way. That is, since the light-emitting element row 2*b* is positioned upstream from the light-emitting element rows 2*a* and 2*c* in the rotation direction of the photoconductive drum 7, the light-emitting element row 2*b* is first energized to emit light towards writing position b. Subsequently, after writing position b reaches the writing position a by the rotation of the photoconductive drum 7 in a direction E of FIG. 3, the light-emitting element rows 2*a* and 2*c* are energized to emit light towards writing position a. Thus, even with the configuration in which the self-focusing lens arrays 3A–3C are arranged in two rows in a staggered configuration, the optical writing device 100 can write information in a straight line in the main scanning direction.

The substrates 5*a*–5*c* are subjected to heat, which is generated by the light emission of the light-emitting element rows 2*a*–2*c* and also by various heat generating components, and are therefore extended. However, since the adjacent substrates 5*a* and 5*b* are connected and fixed around the line $D_{01}$ by the connecting member 8*a* and the adjacent substrates 5*b* and 5*c* are connected and fixed around the line $D_{02}$ by the connecting member 8*b,* as described above, the variations of the distance between the adjacent dots around the lines $D_{01}$ and $D_{02}$ will be insignificantly small, thereby causing no problem in accuracy of the dot writing.

In addition, as shown in FIG. 2, the light-emitting element rows 2*a* and 2*c* are arranged in the side edges of the substrates 5*a* and 5*c,* respectively, close to the substrate 5*b,* and the light-emitting element row 2*b* is arranged in a side edge of the substrate 5*b* close to the substrates 5*a* and 5*c*. This makes the distances significantly small between the adjacent light-emitting element rows 2*a* and 2*b* and between the adjacent light-emitting element rows 2*b* and 2*c*. Thereby, the optical writing device 100 can perform the dot writing operation with significantly small variations both in the main scanning and sub-scanning directions even when the environmental temperature is increased due to the reasons as mentioned above.

Further, the self-focusing rod-shaped lens arrays 3A–3C used in the above configuration are packaged by the single package case 4 and are therefore firmly fixed to each other. Thereby, the relationship of the positions among the self-focusing rod-shaped lens arrays 3A–3C are maintained in a high accuracy of image focusing, even in comparison with a single self-focusing lens array, which ensures a high accuracy, but is extremely expensive. That is, the optical writing device 100 can assure a high accuracy of image focusing at a relatively low manufacturing cost.

Figure 4:
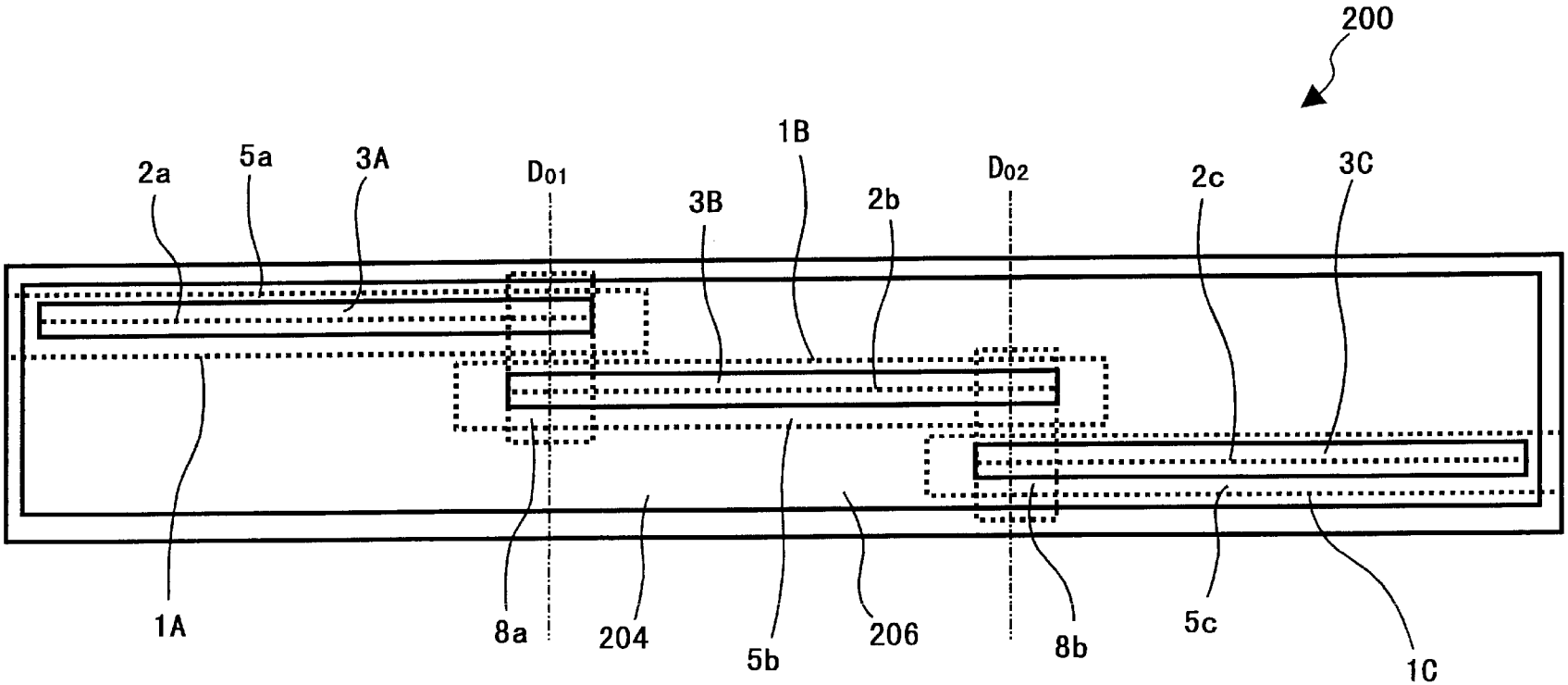
FIG. 4 is a top plan view of a first modified optical writing device based on the optical writing device of FIG. 1.

FIG. 4 shows a first modified optical writing device 200 based on the optical writing device 100. FIG. 4 shows a top plan view of the optical writing device 200. The components and configuration of the optical writing device 200 of FIG. 4 are similar to those of the optical writing device 100 of FIG. 1, except for a package case 204 and a base 206. As shown in FIG. 4, the optical writing device 200 has the light-emitting element array substrates 1A–1C arranged in three rows in a staggered configuration.

In this case, a position, at which an operation for writing dots with the light-emitting elements is switched from the light-emitting element row 2*a* to the light-emitting element row 2*b,* is indicated by the line $D_{01}$, as shown in FIG. 4. Around this line $D_{01}$, the connecting member 8*a* is mounted with adhesive agent on surfaces of the adjacent substrates 5*a* and 5*b* opposite to the surfaces on which the light-emitting element rows 2*a* and 2*b* are mounted so as to connect the substrates 5*a* and 5*b* to each other. Also, a position, at which an operation for writing dots with the light-emitting elements is switched from the light-emitting element row 2*b* to the light-emitting element row 2*c,* is indicated by the line $D_{02}$, as shown in FIG. 4. Around this line $D_{02}$, the connecting member 8*b* is mounted with an adhesive agent on surfaces of the adjacent substrates 5*b* and 5*c* opposite to the surfaces on which the light-emitting element rows 2*b* and 2*c* are mounted so as to connect the substrates 5*b* and 5*c* to each other. Then, a package case 204 and a base 206 are arranged to sit opposite each other relative to the substrates 5*a*–5*c* connected and fixed by the connecting members 8*a* and 8*b,* and are fixed with screws so that the package of the light-emitting element array substrates 1A–1C and the self-focusing rod-shaped lens arrays 3A–3C are packaged into one device, as shown in FIG. 4.

With this configuration, the optical writing device 200 can reduce the variations of the distance between the adjacent dots around the lines $D_{01}$ and $D_{02}$ to an allowable level even when an environmental temperature is increased.

Figure 5:
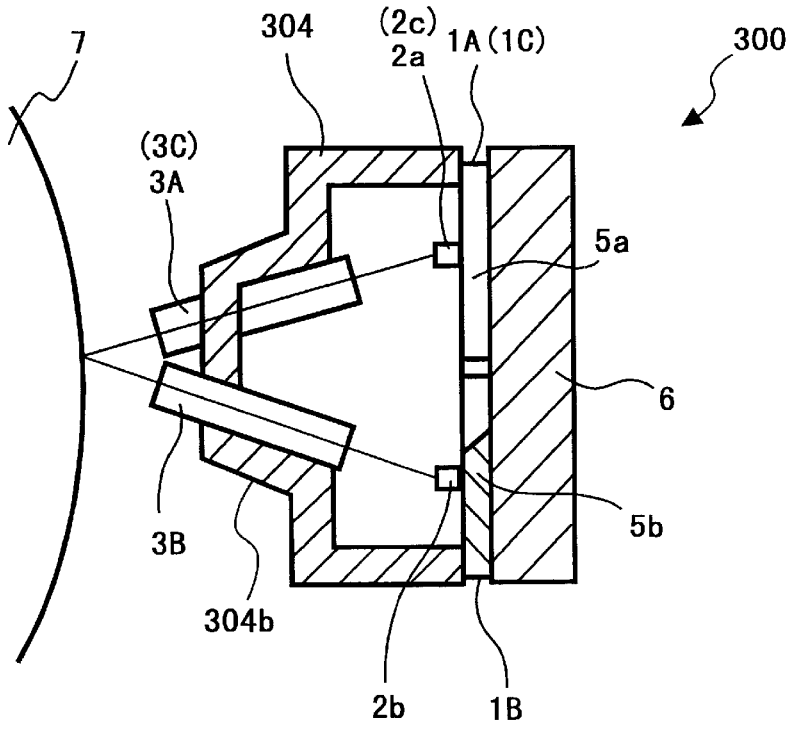
FIG. 5 is a cross-sectional view of a second modified optical writing device based on the optical writing device of FIG. 1 which faces the photoconductive drum.

FIG. 5 shows a second modified optical writing device 300 based on the optical writing device 100. FIG. 5 shows a cross-sectional view of the optical writing device 300 facing the photoconductive drum 7. The components and configuration of the optical writing device 300 of FIG. 5 are similar to those of the optical writing device 100 of FIG. 1, except for a package case 304. In the optical writing device 300, the package case 304 is configured to support the self-focusing rod-shaped lens arrays 3A–3C such that the light emitted from the light-emitting elements of the light-emitting element rows 2*a*–2*c* comes into focus on the surface of the photoconductive drum 7 forming a straight line in the main scanning direction, as shown in FIG. 5.

That is, the light emitted from the light-emitting elements of the light-emitting element rows 2*a*–2*c* mounted on the light-emitting element array substrates 1A–1C, respectively, comes into focus on the same straight line in the sub-scanning direction on the surface of the photoconductive drum 7. Accordingly, this example obviates the needs for controlling the lighting sequence as the optical writing device 100 performs.

Therefore, the optical writing device 300 causes no deviation between the writing lines of the light-emitting element array substrates 1A and 1C and the light-emitting element array substrate 1B.

Figure 6:
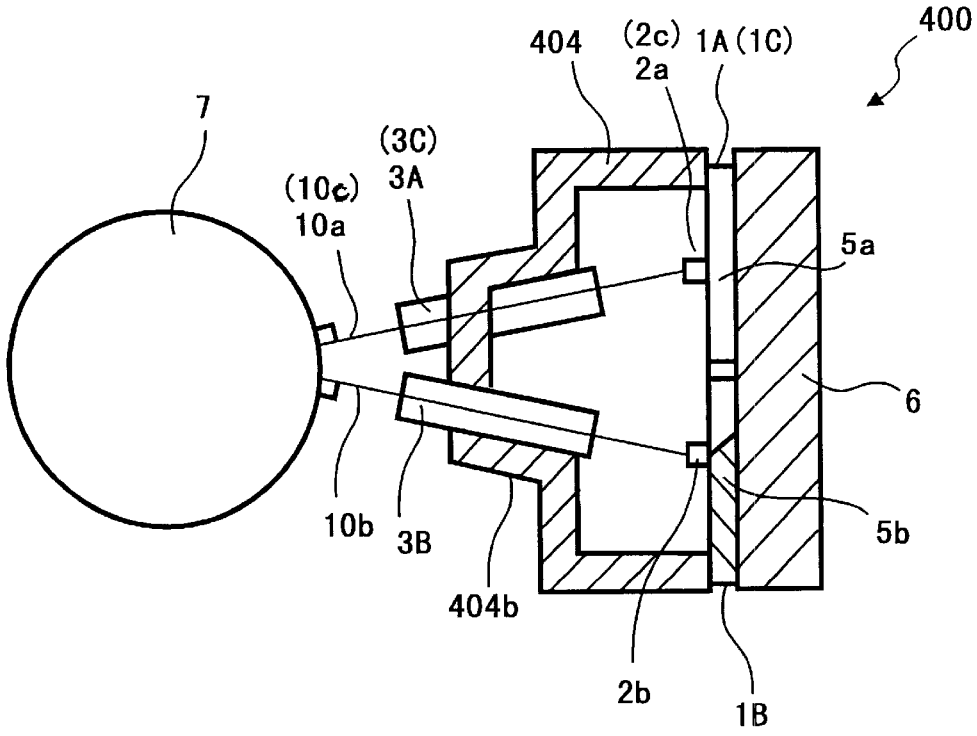
FIG. 6 is a cross-sectional view of a third modified optical writing device based on the optical writing device of FIG. 5 and which faces the photoconductive drum.

FIG. 6 shows a third modified optical writing device 400 based on the optical writing device 300 of FIG. 5. FIG. 6 shows a cross-sectional view of the optical writing device 400 facing to the photoconductive drum 7. The components and configuration of the optical writing device 400 of FIG. 6 are similar to those of the optical writing device 300 of FIG. 5, except for a package case 404. In the optical writing device 400, the package case 404 is configured to support the self-focusing rod-shaped lens arrays 3A–3C with predetermined angles so that each light axes 10*a*–10*c* of the light passing through the self-focusing rod-shaped lens arrays 3A–3C, respectively, is normal to the surface of the photoconductive drum 7, as shown in FIG. 6.

Figure 7:
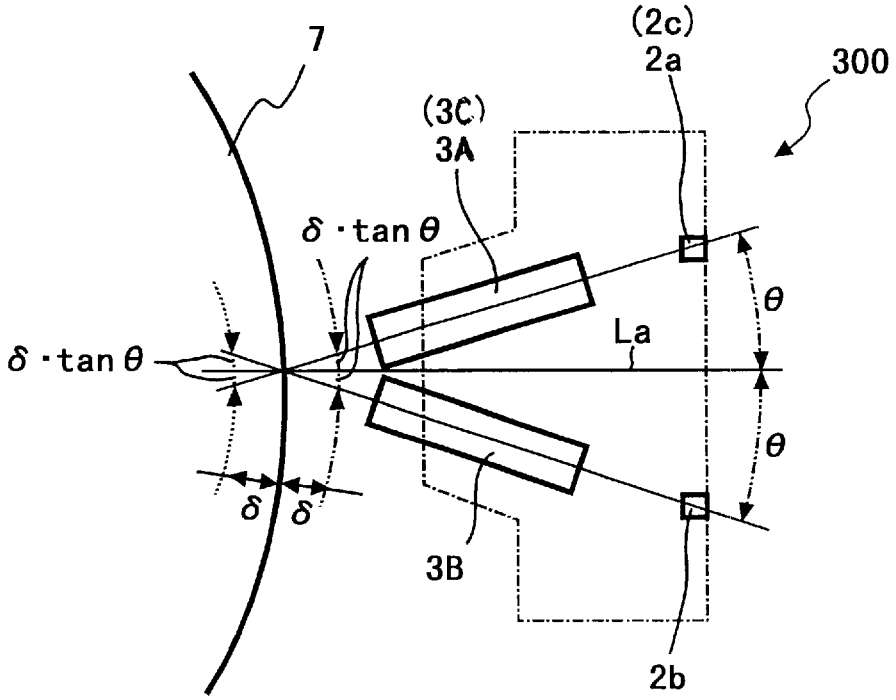
FIG. 7 is a detailed cross-sectional view of the optical writing device of FIG. 5.
Figure 8:
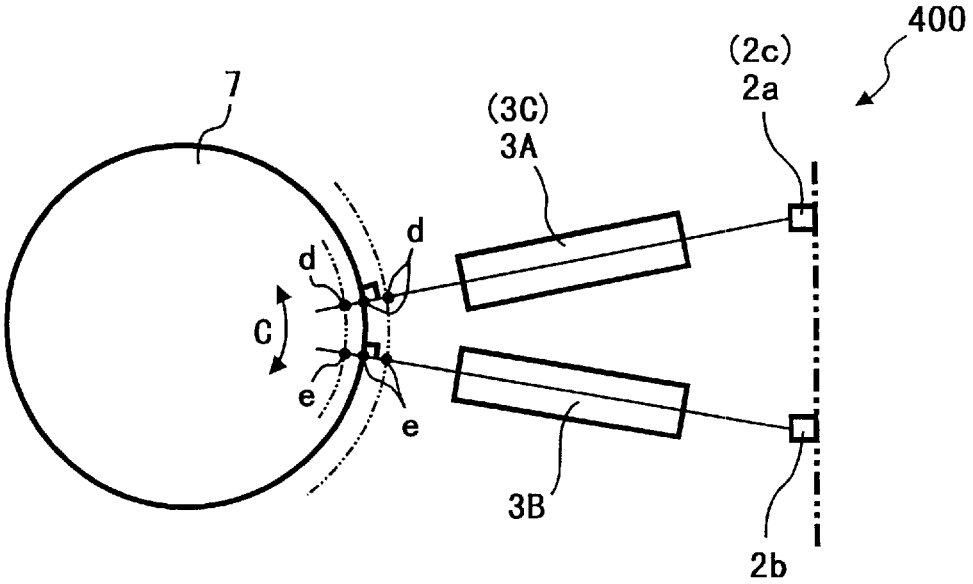
FIG. 8 is a detailed cross-sectional view of the optical writing device of FIG. 6.

With this configuration, the optical writing device 400 can better reduce the deviation of the scanning line than the optical writing device 300 does. That is, in the optical writing device 300 of FIG. 5, the light emitted from the light-emitting elements has an incident angle $\theta$ relative to a line La normal to the tangent of the surface of the photoconductive drum 7, as shown in FIG. 7. In this case, if the circumferential surface of the photoconductive drum 7 has the eccentricity, for example, the distance between the optical writing device 300 and the surface of the photoconductive drum 7 will be changed by $\pm\delta$ as the photoconductive drum 7 rotates, as shown in FIG. 7. This causes a change of the writing position in the sub-scanning direction by $\delta*\tan\theta$ relative to the standard position.

As a result, the focus points on the photoconductive drum 7, caused by the light passing through the self-focusing rod-shaped lens arrays 3A and 3C and by the light passing through the self-focusing rod-shaped lens array 3B, fall and thereby have a distance of $2*\delta*\tan\theta$ as a deviation from the scanning line, since the light passing through the self-focusing rod-shaped lens arrays 3A and 3C and the light passing through the self-focusing rod-shaped lens array 3B have incident angles $\theta$, which are in opposite directions from the line La which is normal to a tangent to the surface of the photoconductive drum 7, as shown in FIG. 7.

However, in the optical writing device 400 of FIG. 6, each of the light axes 10*a*–10*c* of the light passing through the self-focusing rod-shaped lens arrays 3A–3C, respectively, is set to be normal to the surface of the photoconductive drum 7, as shown in FIG. 7. In this case, if the circumferential surface of the photoconductive drum 7 has, for example, any eccentricity, and the distance between the optical writing device 400 and the surface of the photoconductive drum 7 is changed as the photoconductive drum 7 rotates, the focus points d of the light axes 10*a* and 10*c* of the light passing through the self-focusing rod-shaped lens arrays 3A and 3C are not be changed in the sub-scanning direction C. Also, the focus points e of the light axis 10*b* of the light passing through the self-focusing rod-shaped lens arrays 3B is not changed in the sub-scanning direction C.

Numerous additional modifications and variations of the present application are possible in light of the above teachings. It is therefore to be understood that within the scope of the appended claims, the present application may be practiced otherwise than as specifically described herein.

What is claimed as new and desired to be secured Letters Patent of the United States is:

1. An optical writing device, comprising:

a plurality of light-emitting element array substrates, each comprising a plurality of light-emitting elements arranged in a line for emitting light in a straight line, said plurality of light-emitting element array substrates being placed in parallel and partly in an overlapping formation to be able to write on an area of a predetermined width in a direction which said plurality of light-emitting elements of each of said plurality of light-emitting element array substrates are arranged in said line;

a plurality of connecting members, each connecting member for connecting two adjacent light-emitting element array substrates of said plurality of light-emitting element array substrates to each other around a position, at which an operation for writing dots with said plurality of light-emitting elements, is switched from one of said plurality of light-emitting element array substrates to a subsequent one of said plurality of light-emitting element array substrates;

a plurality of self-focusing rod-shaped lens arrays arranged to correspond to said plurality of light-emitting elements in said line of said plurality of light-emitting element array substrates; and a package case for packaging said plurality of light-emitting element array substrates and said plurality of self-focusing rod-shaped lens arrays into one device.

2. The optical writing device as defined in claim 1, wherein said plurality of light-emitting elements and said plurality of self-focusing rod-shaped lens arrays are arranged so that said light emitted from said light-emitting elements of said plurality of light-emitting element array substrates comes into focus in said straight line along a main scanning direction on a writing surface of a writing object rotating in a sub-scanning direction.

3. The optical writing device as defined in claim 2, wherein said plurality of light-emitting elements and said plurality of self-focusing rod-shaped lens arrays are arranged so that each light axis of said light emitted from said light-emitting elements of said plurality of light-emitting element array substrates passes through said plurality of self-focusing rod-shaped lens arrays and is normal to said writing surface of said writing object.

4. The optical writing device as defined in claim 1, wherein said plurality of light-emitting elements and said plurality of self-focusing rod-shaped lens arrays are arranged so that each light axis of said light emitted from said light-emitting elements of said plurality of light-emitting element array substrates passes through said plurality of self-focusing rod-shaped lens arrays and is normal to a writing surface of a writing object.

5. An optical writing device, comprising:

a plurality of light-emitting element array substrate means, each comprising a plurality of light-emitting element means arranged in a line for emitting light in a straight line, said plurality of light-emitting element array substrate means, located parallel to each other and partly in an overlapping formation, for writing on an area of a predetermined width in a direction which said plurality of light-emitting element means of each of said plurality of light-emitting element array substrate means are arranged in said line;

a plurality of connecting means, each connecting means for connecting two adjacent light-emitting element array substrate means of said plurality of light-emitting array substrate means to each other around a position, at which an operation for writing dots with said plurality of light-emitting element means, is switched from one of said plurality of light-emitting element array substrate means to a subsequent one of said plurality of light-emitting element array substrate means;

a plurality of self-focusing rod-shaped lens array means arranged to correspond to said plurality of light-emitting element means in said line of said plurality of light-emitting element array substrate means; and package means for packaging said plurality of light-emitting element array substrate means and said plurality of self-focusing rod-shaped lens array means into one device.

6. The optical writing device as defined in claim 5, wherein said plurality of light-emitting element means and said plurality of self-focusing rod-shaped lens array means are arranged so that said light emitted from said light-emitting element means of said plurality of light-emitting element array substrate means comes into focus in said straight line along a main scanning direction on a writing surface of a writing object rotating in a sub-scanning direction.

7. The optical writing device as defined in claim 6, wherein said plurality of light-emitting element means and said plurality of self-focusing rod-shaped lens array means are arranged so that each light axis of said light emitted from said light-emitting element means of said plurality of light-emitting element array substrate means passes through said plurality of self-focusing rod-shaped lens array means and is normal to said writing surface of said writing object.

8. The optical writing device as defined in claim 5, wherein said plurality of light-emitting element means and said plurality of self-focusing rod-shaped lens array means are arranged so that each light axis of said light emitted from said light-emitting element means of said plurality of light-emitting element array substrate means passes through said plurality of self-focusing rod-shaped lens array means and is normal to a writing surface of a writing object.

9. A method for optical writing, comprising the steps of:

providing a plurality of light-emitting elements to a light-emitting element array substrate for emitting light in a straight line;

placing a plurality of said light-emitting element array substrates, each light-emitting element array substrate having said plurality of light-emitting elements at positions in parallel and in a partly overlapping formation to be able to write on an area of a predetermined width in a direction in which said plurality of light-emitting elements of each of said plurality of said light-emitting element array substrates emit said light in said straight line;

connecting adjacent two of said plurality of said light-emitting element array substrates around a position, at which an operation for writing dots with said plurality of light-emitting elements, is switched from one of said plurality of said light-emitting element array substrates to a subsequent one of said plurality of light-emitting element array substrates;

arranging a plurality of self-focusing rod-shaped lens arrays at positions corresponding to positions of said plurality of light-emitting elements mounted to said plurality of said light-emitting element array substrates; and packaging said plurality of said light-emitting element array substrates and said plurality of self-focusing rod-shaped lens arrays into one device.

10. The method as defined in claim 9, wherein said step for providing said plurality of light-emitting elements and said step for arranging said plurality of self-focusing rod-shaped lens arrays are performed so that said light emitted from said light-emitting elements of said plurality of said light-emitting element array substrates come into focus in said straight line along a main scanning direction on a writing surface of a writing object rotating in a sub-scanning direction.

11. The method as defined in claim 10, wherein said step for providing said plurality of light-emitting elements and said step for arranging said plurality of self-focusing rod-shaped lens arrays are performed so that each of light axes of said light emitted from said light-emitting elements of said plurality of said light-emitting element array substrates and passing through said plurality of self-focusing rod-shaped lens arrays is normal to said writing surface of said writing object.

12. The method as defined in claim 9, wherein said step for providing said plurality of light-emitting elements and said step for arranging said plurality of self-focusing rod-shaped lens arrays are performed so that each of light axes of said light emitted from said light-emitting elements of said plurality of said light-emitting element array substrates and passing through said plurality of self-focusing rod-shaped lens arrays is normal to a writing surface of a writing object.

* * * * *